United States Patent [19]

Davila et al.

[11] Patent Number: 5,076,413

[45] Date of Patent: Dec. 31, 1991

[54] MULTIPLE BILL ESCROW AND STORAGE APPARATUS

[75] Inventors: Jose Davila, Bourbonnais; Kirk D. Hoffman, Yorkville; Norman Diamond, Deerfield, all of Ill.

[73] Assignee: General Signal Corporation, High Ridge Park, N.Y.

[21] Appl. No.: 553,079

[22] Filed: Jul. 13, 1990

[51] Int. Cl.[5] ..... G07F 7/04; B65B 69/00

[52] U.S. Cl. ..... 194/206; 414/417

[58] Field of Search ..... 194/205, 206, 207; 902/7, 11; 235/379; 414/417

[56] References Cited

U.S. PATENT DOCUMENTS

| | | | |
|---|---|---|---|
| 3,788,333 | 1/1974 | Johnson | 194/206 X |
| 4,011,931 | 3/1977 | Wyckoff | 194/206 |
| 4,540,081 | 9/1985 | Mori et al. | 902/7 X |
| 4,678,072 | 7/1987 | Kobayashi et al. | 194/206 |
| 4,784,274 | 11/1988 | Mori et al. | 194/206 X |
| 4,807,736 | 2/1989 | Kondo et al. | 194/206 |
| 4,809,966 | 3/1989 | Kobayashi et al. | 194/206 X |
| 4,834,230 | 5/1989 | Kondo et al. | 194/206 |
| 4,880,096 | 11/1989 | Kobayashi et al. | 194/206 |

FOREIGN PATENT DOCUMENTS

| | | | |
|---|---|---|---|
| 8605301 | 9/1986 | European Pat. Off. | 194/206 |
| 0027700 | 3/1977 | Japan | 194/206 |
| 0090994 | 8/1978 | Japan | 194/207 |

*Primary Examiner*—Robert J. Spar
*Assistant Examiner*—Scott L. Lowe
*Attorney, Agent, or Firm*—Robert R. Hubbard; John F. Ohlandt

[57] ABSTRACT

A multiple bill escrow and storage apparatus provides in combination: a validator unit for validating paper money bills which has an outlet through which each accepted bill is ejected; a receiver of bills from the validator unit; a conveyor disposed near the receiver, the conveyor being capable of moving a bill from the validator unit to a handling station; an escrow box disposed adjacent the handling station, the escrow box having a retaining device for holding multiple bills therein; a transfer device mounted at the handling station for transferring a bill from the conveyor into the escrow box, the transfer device comprising a pusher reciprocally movably mounted opposite the escrow box; a vault mounted adjacent the escrow box; an actuating device coupled to the transfer device for selectively transferring a bill into the escrow box and from the escrow box into the vault, the actuating device being capable of driving the pusher through the conveyor to push the bill from the conveyor into the escrow box; a mechanism for reciprocally moving the escrow box between the handling station and an ejection station; and an ejecting device disposed at the ejection station for ejecting the bills contained in the escrow box wherein the ejected bill are ejected in a folded state.

9 Claims, 12 Drawing Sheets

MULTIPLE BILL ESCROW AND STORAGE APPARATUS

An apparatus which is capable of accepting multiple bills, such as paper money, in any denominations and retaining the bills in a temporary pattern or escrow. If the transaction is cancelled for any reason, then all the bills currently in escrow are returned to the user. However, if the transaction is completed, then the bills in escrow are transported to a vault.

BACKGROUND OF THE INVENTION

Most conventional vending and money changing machines that accept paper money are designed to process one bill at a time. The problem with these machines is that they become inadequate if the value of the purchase requires more than one bill, as in the case of bus, air, or railway fares.

A typical conventional bill escrow and storage apparatus used with vending machines is set forth in U.S. Pat. No. 4,011,931 (Wyckoff), which issued on Mar. 15, 1977. The Wyckoff patent discloses an apparatus for handling paper money in a vending or money changing machine, in which a validator unit either accepts or rejects an inserted bill. Each accepted bill is moved a short distance by a conveyor to a handling station, where a ram pushes the bill into an escrow box in which the bill is held until the associated transaction is completed. When the transaction is complete, the ram pushes the bill through the escrow box into a stacker or storage vault. If the transaction is not completed, the escrow box swings down and the bill is ejected for return to the customer.

One known attempt at processing multiple bills in a vending or money changing machine is the Banknote Processing System sold by Sodeco-SAIA Ltd. of Geneva, Switzerland. This system includes an escrow unit which may be used either in direct collection mode or in intermediate collection mode. In the latter case, up to ten notes may be provisionally stored on a drum. If, for example, a customer should realize that he or she has not enough money to reach the amount required or change his or her mind and decide to cancel the transaction, then it is possible for the user to interrupt the sales process and have the deposited bills returned in the form of a wad. If the transaction takes place, the bills are directed to the final cash box, where they are stacked and kept in complete security.

Whatever the merits of the above-cited known forms of vending apparatus, they lack the ability for handling multiple bills of varying denominations in accomplishing a variety of complex vending transaction so as to satisfy customers' needs.

Accordingly, a primary object of the present invention is to enable simplified and efficient transfer of multiple bills from a handling station to an escrow box and then to a vault or storage means within a vending machine or the like.

A further object is to provide an arrangement for efficiently and conveniently returning a plurality of bills to a customer when the transaction has been cancelled for any reason.

Another object is to insure absolute security of the money vault, particularly as to guaranteeing that the processing of bills can only commence if the vault has been locked into the machine.

The present invention also provides many additional advantages which shall become apparent as described below.

SUMMARY OF THE INVENTION

The apparatus described herein is capable of handling multiple bills for an individual transaction and is adaptable to a variety of vending and money changing machines. Bills are fed in any multiple and denominations into the apparatus by a validator unit, which either accepts or rejects each individual bill. If a bill is rejected it is immediately returned to the customer at the insertion point.

When a valid bill is accepted, the bill emerges from the rear of the validator unit into a short conveyor, which is started by the acceptance action. Each bill is carried by the conveyor to a handling station where the bill stops. This action initiates a reciprocal transfer pusher which pushes the bill into an escrow box, which is in a sidewise relationship with the conveyor, such that the bill is held between spring loaded platens and overlapping retaining flaps. Thereafter, the process is repeated until the correct number of bills necessary for completing the transaction are contained within the escrow box.

While the machine is performing its operations, previously processed bills are held in the escrow box. When the associated transaction is completed, the pusher is again actuated to drive the bills through the escrow box into a stacker or storage vault.

The present invention provides a novel bill escrow and storage apparatus which is capable of receiving multiple bills in escrow and returning such bills to the user if the transaction is cancelled for any reason. The apparatus has a unique arrangement for the escrow box, including ejection means for returning multiple bills to the user in a folded state.

The escrow box is reciprocally movably mounted between the handling station and an ejection station. Thus, if the transaction is cancelled for any reason, the escrow box containing the bills is moved vertically downward until it is opposite the ejection means. Once the escrow box is positioned opposite the ejection means a return plate is actuated, whereby the bills contained within the escrow box are removed therefrom and returned to the user in a folded state via a return compartment.

A control unit is coupled to the validator unit for receiving signals from the validator unit representative of the bills, and for calculating the total value of the bills.

Briefly stated, a primary feature of the present invention resides in a multiple bill escrow and storage apparatus, comprising: a validator unit for validating paper money bills having an outlet through which each accepted bill is ejected; a means capable of receiving bills from the validator unit; a conveyor means disposed near the receiving means, the conveyor means being capable of moving a bill from the validator unit to a handling station; an escrow box disposed adjacent the handling station, the escrow box having retaining means for holding multiple bills therein; transfer means mounted at the handling station for transferring a bill from the conveyor means into the escrow box, the transfer means being reciprocally movably mounted opposite the escrow box; a vault mounted adjacent the escrow box; actuating means coupled to the transfer means for selectively transferring a bill into the escrow box and from the escrow box into the vault, the actuating means being capable of driving the transfer means through the conveyor means to push a bill or bills from the conveyor means into the escrow box; means for reciprocally moving the escrow box between the handling station and an ejection station; and an ejection means disposed at the ejection station for ejecting the bill or bills contained in the escrow box such that the ejected bill or bills are ejected in a folded state.

The ejection means comprises a return plate reciprocally movably mounted opposite the escrow box when in the ejection station and an actuating means driving the return plate through an opening in the escrow box to push the bills from the escrow box into a return compartment. The return compartment includes pressure means for exerting sufficient pressure on the bill or bills against the return plate whereby the bill or bills are retained on the return plate and released from the escrow box; and means for retaining the bill or bills in a forward position within the return compartment, the retaining means providing the necessary force to keep the bill or bills from sliding back as the return plate is retracted from the return compartment.

Another feature of the present invention resides in a vault comprising a high security box with a stacker. The vault has three levels of security. Two levels are in the nature of mechanical keys, and one level consists of an electronic identification code. The vault has a battery operated signal emitter, and the vending apparatus has a signal receiver. Only the programmed signal from the vault will turn on the acceptance cycle of the vending machine. The signal from the vault will be transmitted only if the vault is locked into position inside the vending machine.

Other and further objects, advantages and features of the present invention will be understood by reference to the following specification in conjunction with the annexed drawings, wherein like parts have been given like numbers.

BRIEF DESCRIPTION OF THE DRAWINGS

FIG. 5 is a view taken along the line 5—5 in FIG. 2, showing a bill held within the escrow box;

DESCRIPTION OF THE PREFERRED EMBODIMENT

Figure 1:
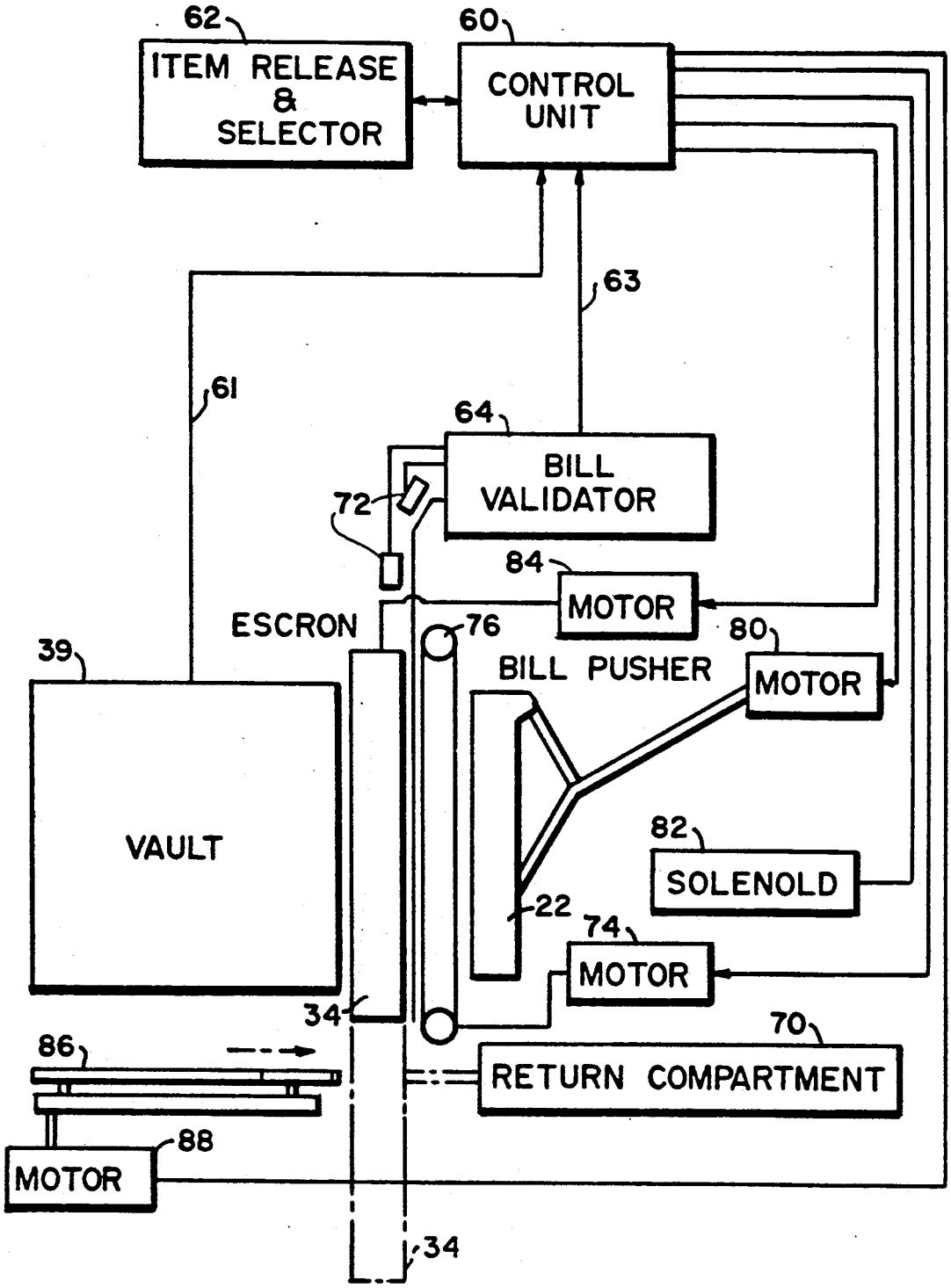
FIG. 1 is a schematic diagram of the multiple bill escrow and storage apparatus in accordance with the present invention.
Figure 2:
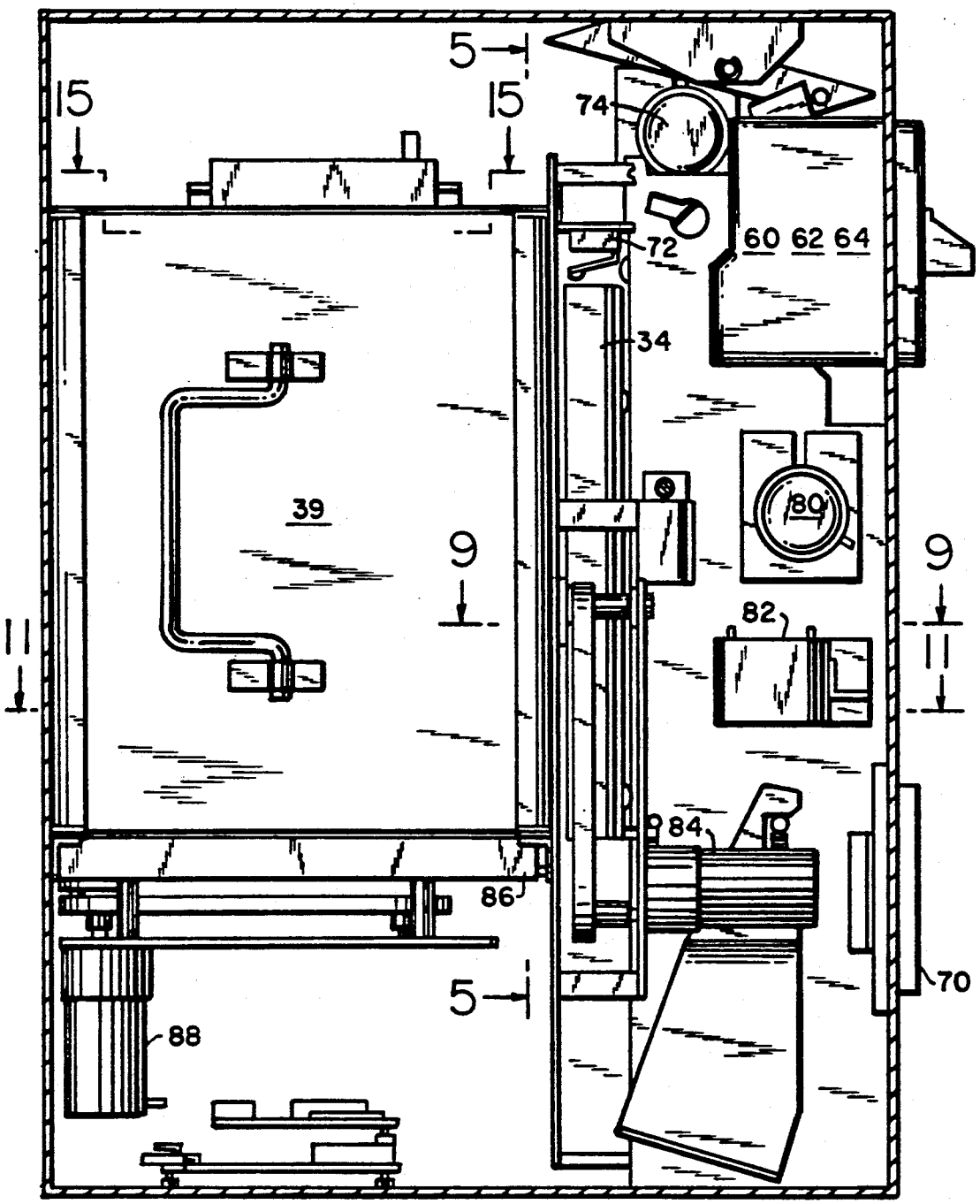
FIG. 2 is a side view of the apparatus in accordance with the present invention.

The invention can best be described by referring to the attached drawings, wherein FIGS. 1 and 2 depict a typical multiple bill escrow and storage apparatus according to the present invention. The apparatus, in schematic form, includes a control unit 60, an item release/selector 62, a bill validator 64, escrow box 34, vault 39 and return compartment 70.

It should be especially noted that the control unit 60 is provided with a microprocessor (not shown) which is suitably programmed to achieve the following objectives: (1) to enable the bill processing operation to be initiated, by reason of the connection of control cable 61 extending from the vault 39 to the microprocessor; such enablement being responsive to signals indicating that the vault has been properly inserted and locked in place in the machine or apparatus; (2) to calculate the cumulative amount of the bills inserted and to compare the total with the value of a given item for sale; (3) to keep track of the precise number of valid bills received for the given item of value and to enable movement along the conveyor means of each of the bills inserted by a customer; (4) to stop the conveyor means upon completion of the transmission and escrow storage of all of the particular valid bills involved in a given transaction; for example, if two valid twenty dollar bills are received for a forty dollar item, the conveyor means will be stopped after two transmissions, whereas if four ten-dollar bills are received, it is necessary to execute four transmissions.

The transaction in a vending or money changing machine starts with a customer inserting a bill (paper money) into bill validator 64. The control unit 60 receives, by means of connection 63, signals from validator unit 64 representative of multiple bills. As a bill passes through validator 64 and is detected by sensors 72, a signal is sent from control unit 60 to motor 74. Motor 74 activates various feed rollers (not seen) and drives conveyor 76, which comprises a pair of friction belts driven by pulleys. The bill is carried via conveyor 76 to the handling station which is situated between escrow box 34 and pusher 22. Sensors (not seen) signal control unit 60 when the bill is positioned within the handling station and directly opposite bill pusher 22. If bill validator 64 rejects the bill then the drive mechanism of validator 64 will reverse, returning the bill to the customer.

It will be understood that since multiple bills are involved in many transactions, the above and later described operations are repeated for each bill.

When the bill is in position, the sensors (not seen) will signal control unit 60, which in turn will send a signal to motor 80 which activates pusher 22. The forward movement of pusher 22 through conveyor 76 forces the bill into escrow box 34. This is commonly referred to as the short stroke cycle of pusher 22.

If the transaction is completed, solenoid 82 is energized to pull a shaft (not seen) which initiates the long stroke cycle. During the long stroke cycle motor 80 activates pusher 22 which pushes the bills currently held in escrow box 34 into vault 39.

If the transaction is not completed because the customer runs out of money, changes his or her mind or for any other reason, then the customer pushes the return button (not shown). The return button activates motor 84 which moves escrow box 34 downward to the ejection station disposed between ejection means 86 and return compartment 70. Once escrow box 34 is in position within the ejection station, motor 88 is activated such that ejection means 86 forces the bills from escrow box 34 and into return compartment 70. After the bills have been removed from escrow box 34, escrow box 34 returns to the handling station.

FIGS. 3–18 describe the apparatus of the present invention in greater detail. As stated above, transaction begins when the customer inserts a bill into the bill validator 64. As the bill passes through validator 64 into receiving means 11, sensors 12 and 13 start motor 14 to drive feeder rollers 15, 16, and 17. Conveyor 76, provided with two spaced belts 21, drives the bill down against wall 20. Wall 20 has low friction and belts 21 have high friction. The bill will move in this path until reaching "shoulder" seen in FIG. 3, at which point sensors 18 and 19 generate a signal indicating that the bill has passed through and is in position in front of pusher 22.

Figure 9:
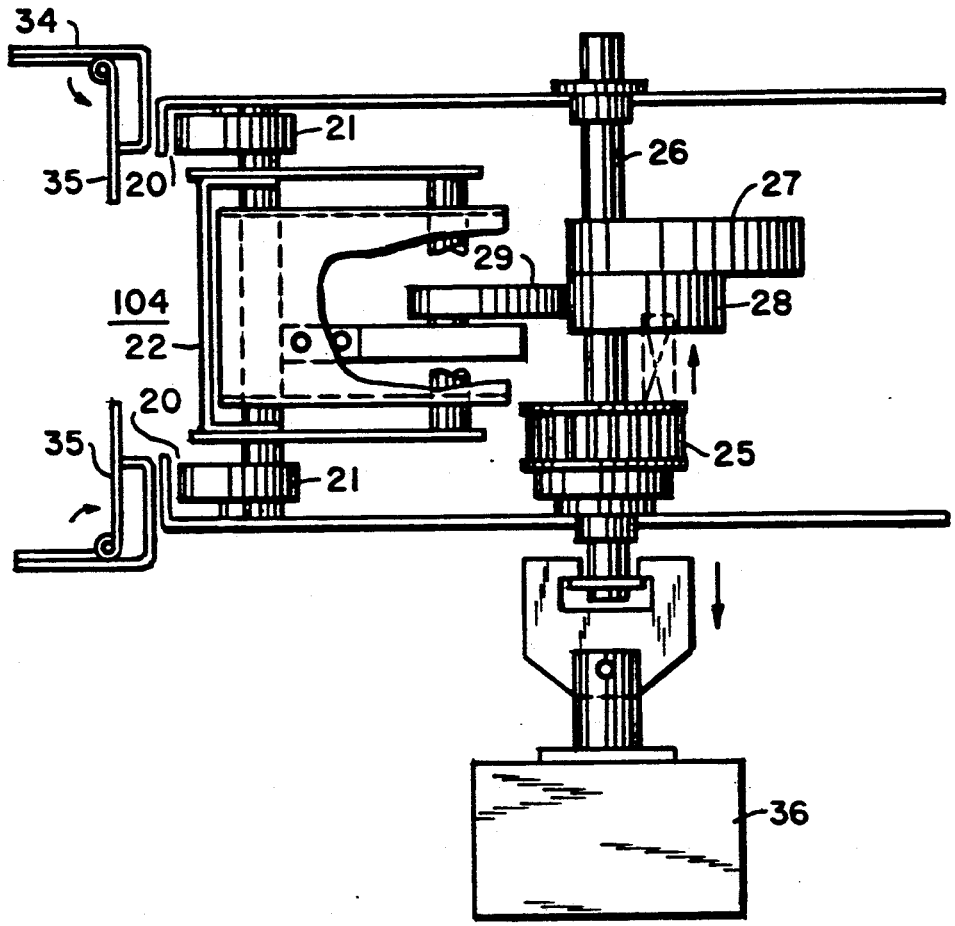
FIG. 9 is a view taken on the line 9—9 in FIG. 2, in which the pusher is in a retracted position relative to the escrow box.
Figure 10:
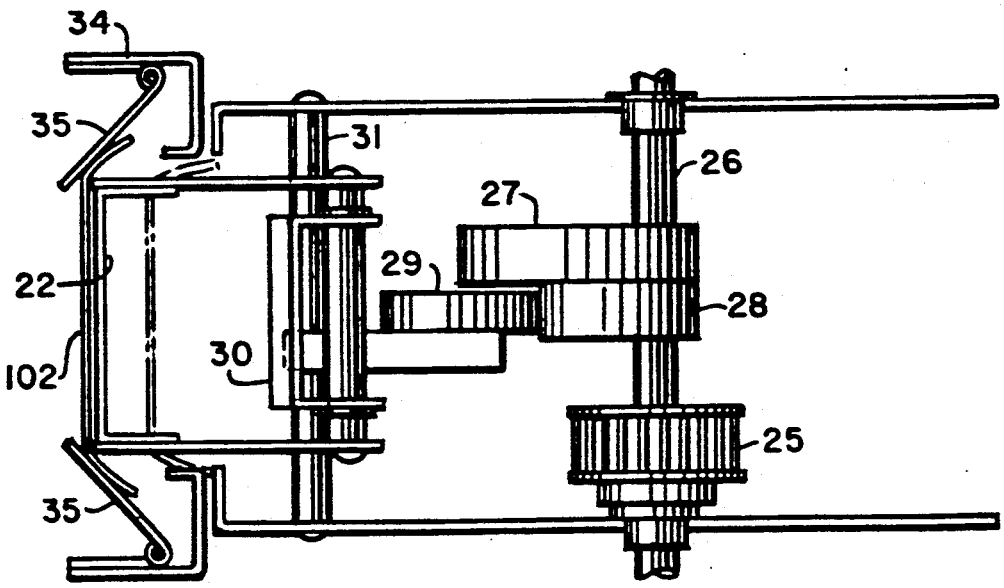
FIG. 10 is a view similar to FIG. 9, but in which the vault, stacker, and solenoid are also shown and in which the pusher is fully extended into the escrow box in a short-stroke cycle.
Figure 11:
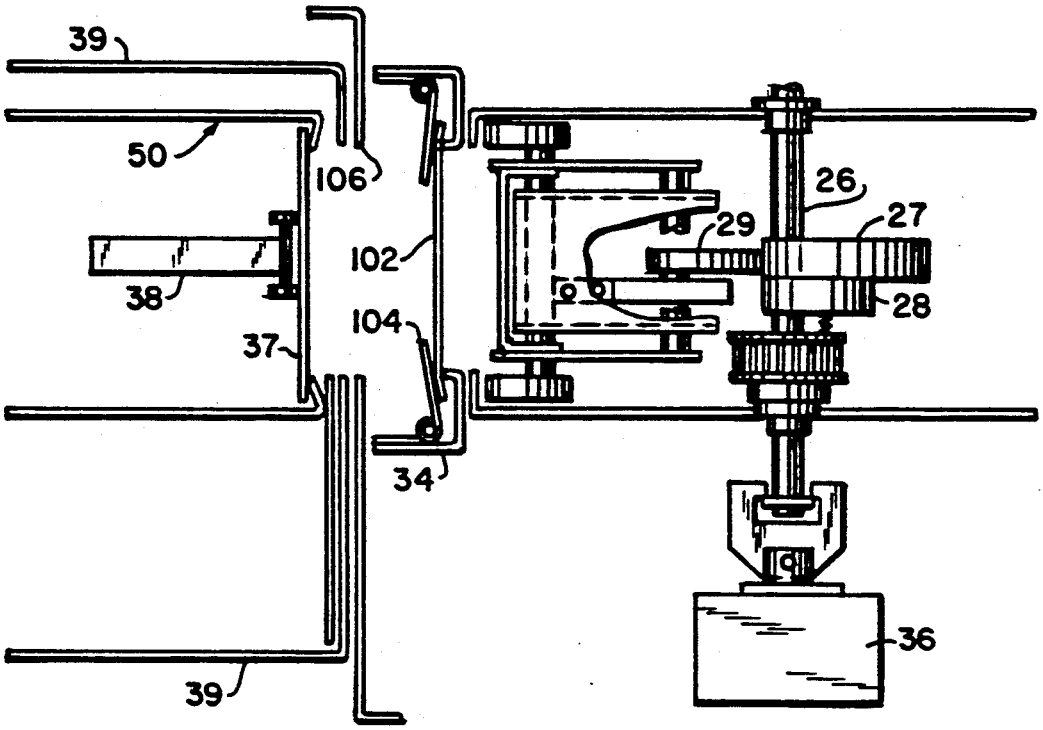
FIG. 11 is a view taken on the line 11—11 in FIG. 2, in which the pusher is in a retracted position after a bill has been placed into the escrow box and held there.
Figure 12:
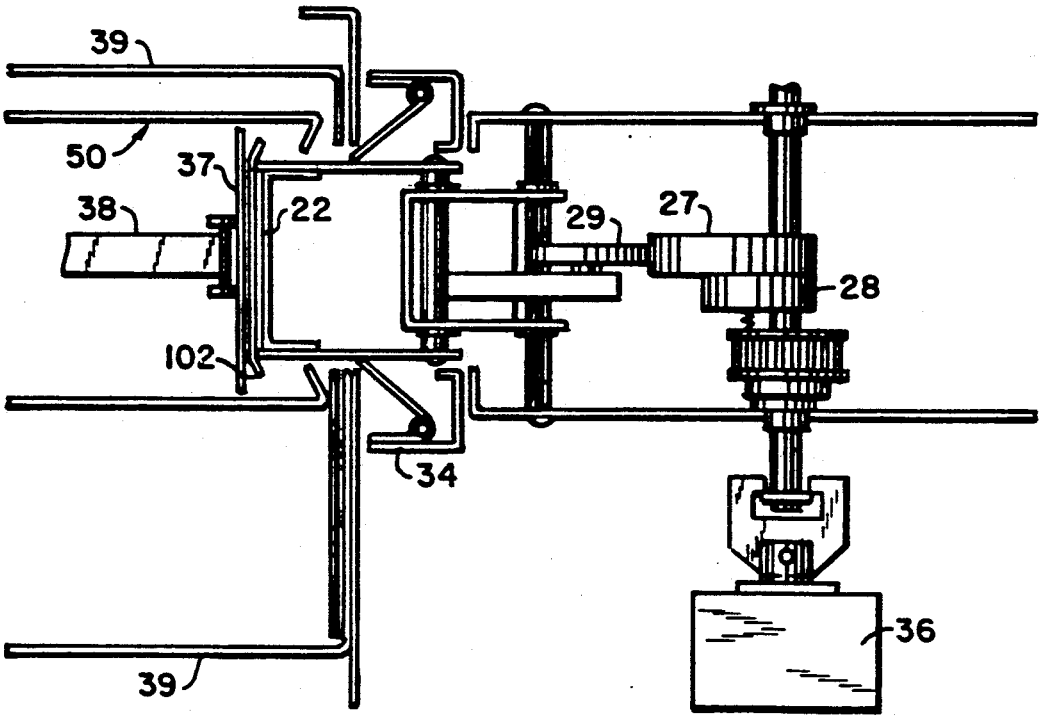
FIG. 12 is a view similar to FIG. 11, but in which the pusher has been extended into the vault.
Figure 13:
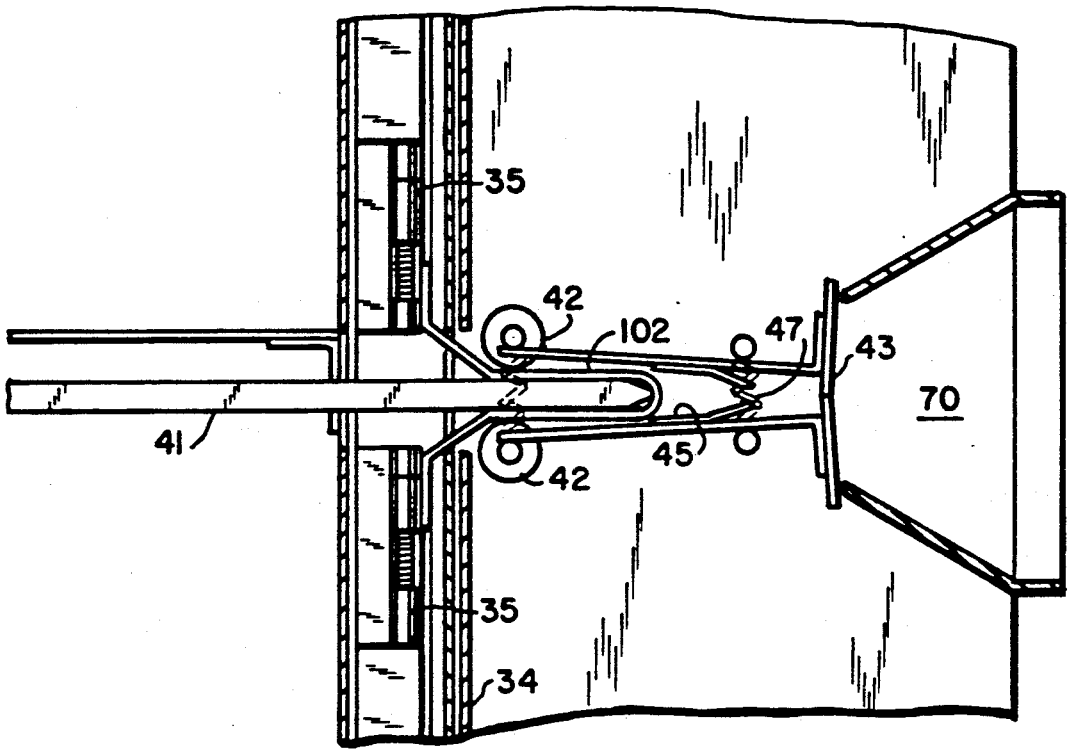
FIG. 13 is a cross-sectional view of the ejection station wherein multiple bills are being removed from the escrow box by ejection means and placed within a return compartment.
Figure 14:
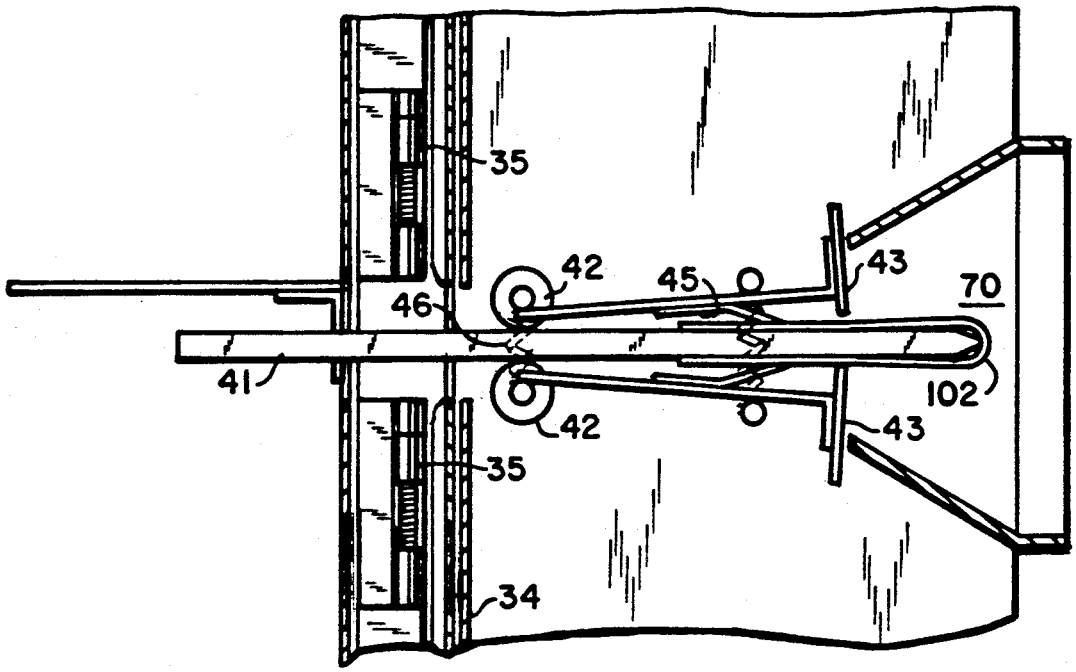
FIG. 14 is a cross-sectional view of the ejection station wherein multiple bills are positioned about the ejection means and completely within a return compartment.
Figure 15:
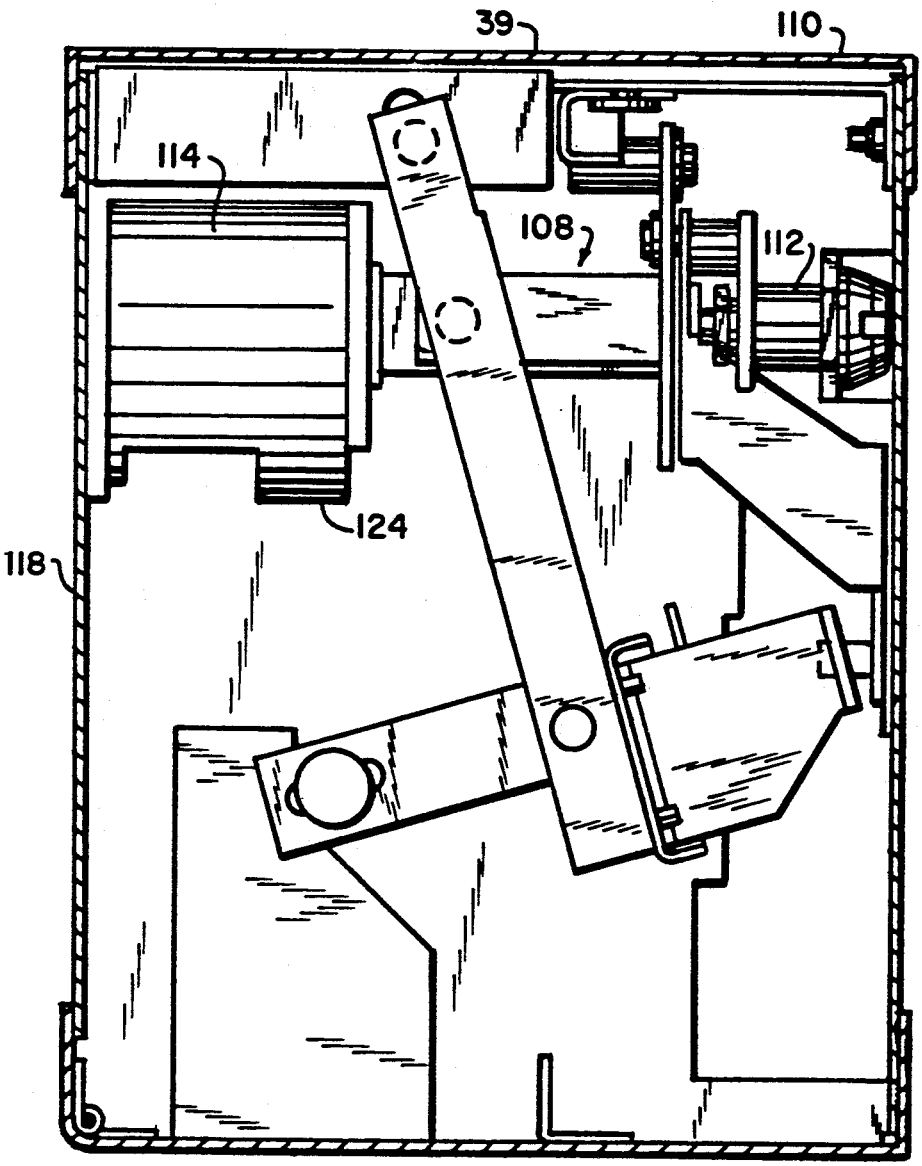
FIG. 15 is a view taken on the line 15—15 in FIG. 2, particularly showing the security scheme for the vault, involving opening and closing of gate or door 110.

When the bill is in position, sensors 18 and 19 will send a signal to a motor (not shown) such that a belt (not shown) turns gear 25. Shaft 26 (as shown in FIG. 9) drives eccentric cams 27 and 28. Roller 29, pushed by cam 28, forces lever 30 to pivot around shaft 31. Lever 30 is pivotally attached to lever 33 (FIG. 6) and together, levers 30 and 33 attached to pusher 22, force the forward movement of pusher 22. As the bill is caught between path 20 and belts 21, the forward movement of pusher 22 extends in the space between belts, thereby forcing the bill away from belts 21 to escrow box 34 and through opening 104 therein into flaps 35. This is called the short stroke cycle of pusher 22. The ends of the bill 102 are bent, as seen in FIG. 10. When pusher 22 returns as cam 28 continues the full rotation, spring-loaded flaps 35 close down on the bill, such that a given bill will be captured within escrow box 34. Escrow box 34 has a preferred capacity of approximately ten bills.

If the transaction is completed, solenoid 36 is energized to pull on shaft 26. Cam 27 is presented to roller 29 and motor 23 starts to rotate, moving pusher 22 into the long stroke cycle to push the bill or bills far enough to pass through flaps 35 which are separated by pusher 22. (See FIGS. 11 and 12). The bills pass inside stacker 50 contained within vault 39. When pusher 22 returns by means of a spring (not shown) the bills spring open inside stacker 50 and are held in position by pressure plate 37, which is attached to, and biased by, spring 38.

If the transaction is not completed because the customer runs out of money, changes his or her mind, or for any other reason, then the customer pushes the return button (not shown). The return button activates the already noted mechanism to move escrow box 34 downward. (See FIG. 4). The center section of escrow box 34 is provided with another opening 106, on the left side of escrow box 34. Thus two openings 104 and 106 permit the passage of ejection means or return plate 41, with spring 46 and rollers 42 exerting pressure on the bills against return plate 41. (See FIGS. 13 and 14). The pressure retains the bills on plate 41 assisting the removal of bills from flaps 35. As plate 41 advances forward, security plates 43 are forced apart exposing the bills to opening 44. Stripper plates 45 hold the bills in the forward position. (See FIG. 14). As plate 41 retracts, spring 47 provides the necessary force to keep the bills from sliding back with plate 41. When plate 41 retracts to its original position, escrow box 34 moves up to the handling station, such that the machine is now ready to accept more bills.

Figure 3:
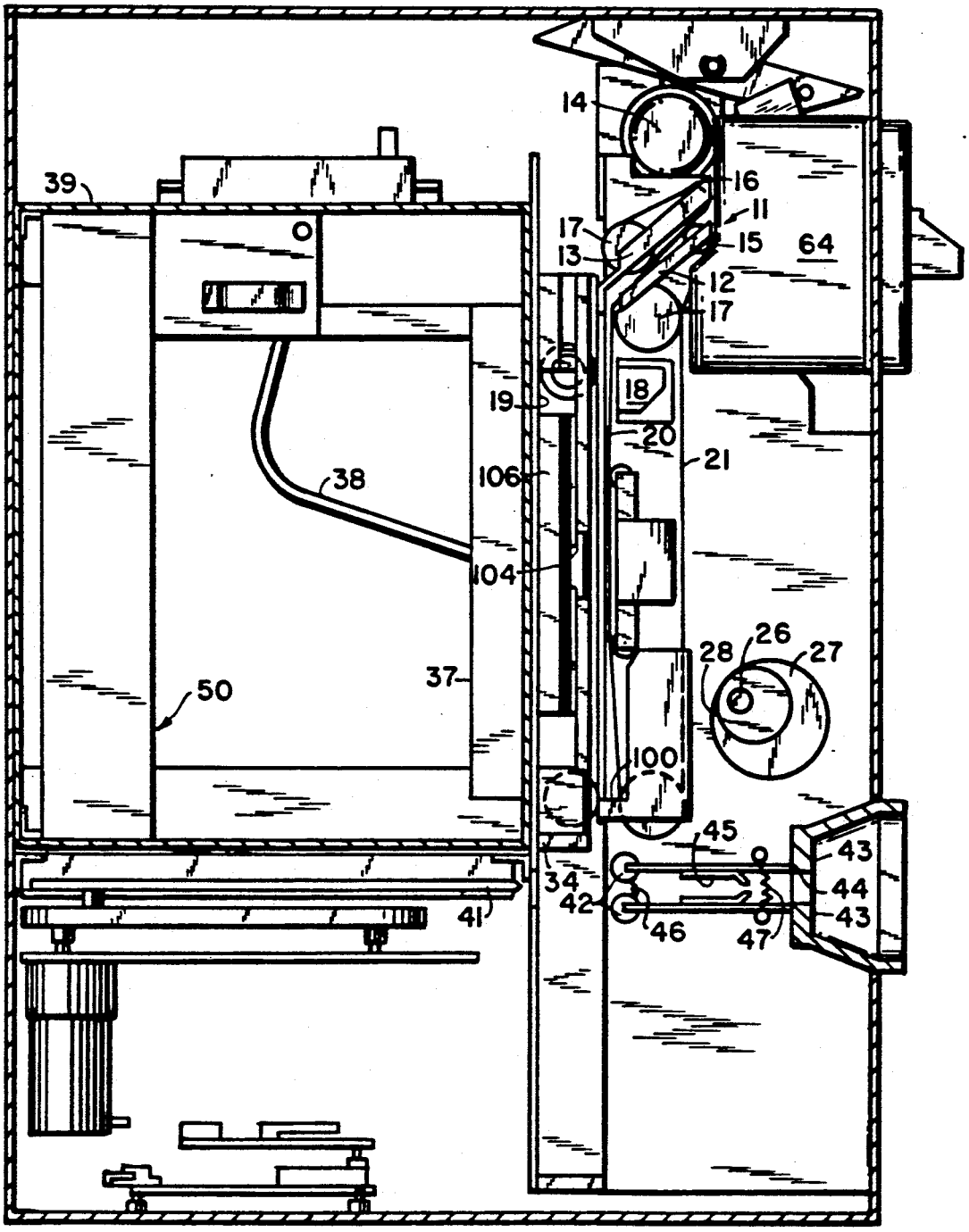
FIG. 3 is a side view, partly in section, of the apparatus in accordance with the present invention, with the escrow box shown in a first or upper position.
Figure 4:
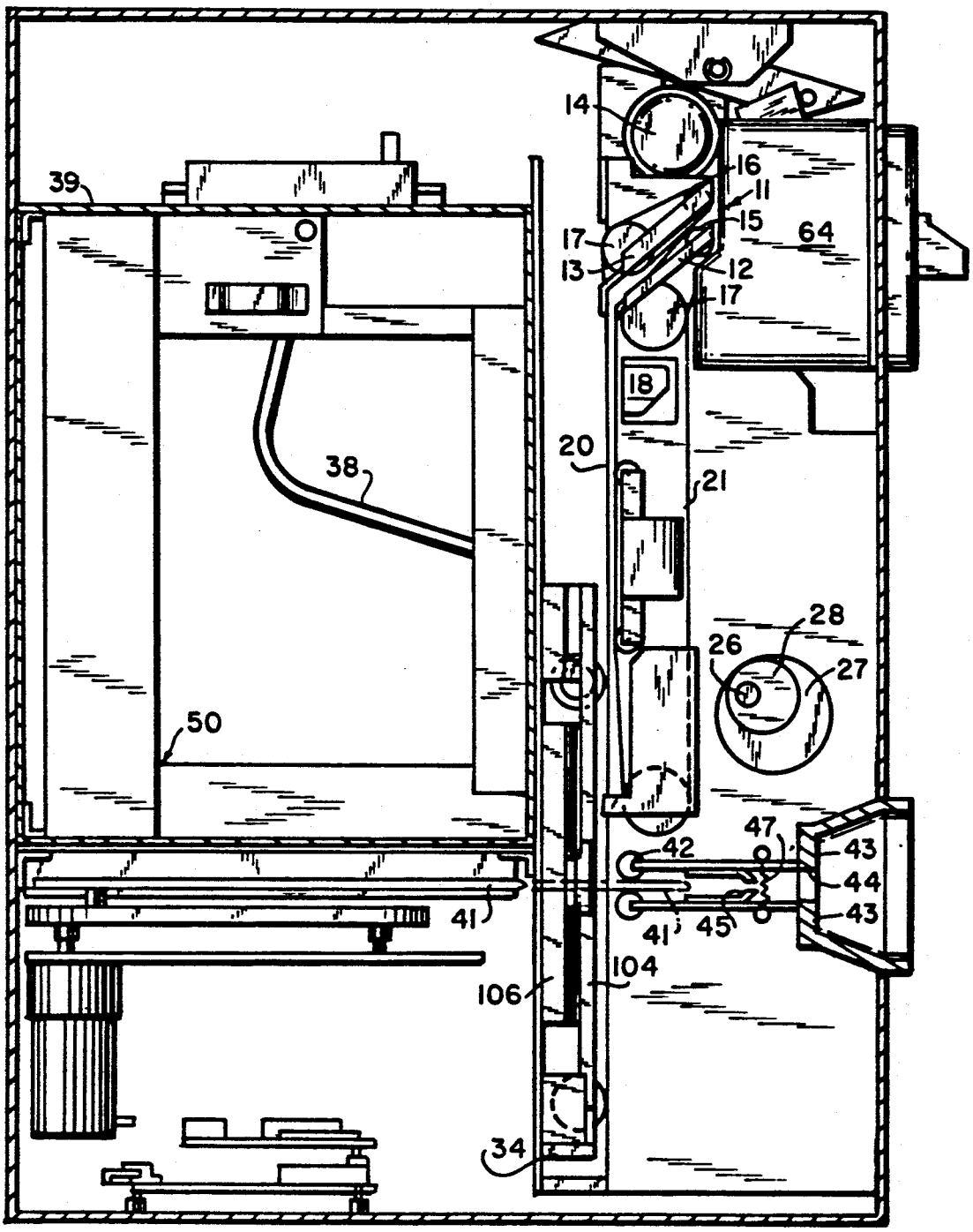
FIG. 4 is a view similar to FIG. 3, but with the escrow box moved down to a second position.
Figure 6:
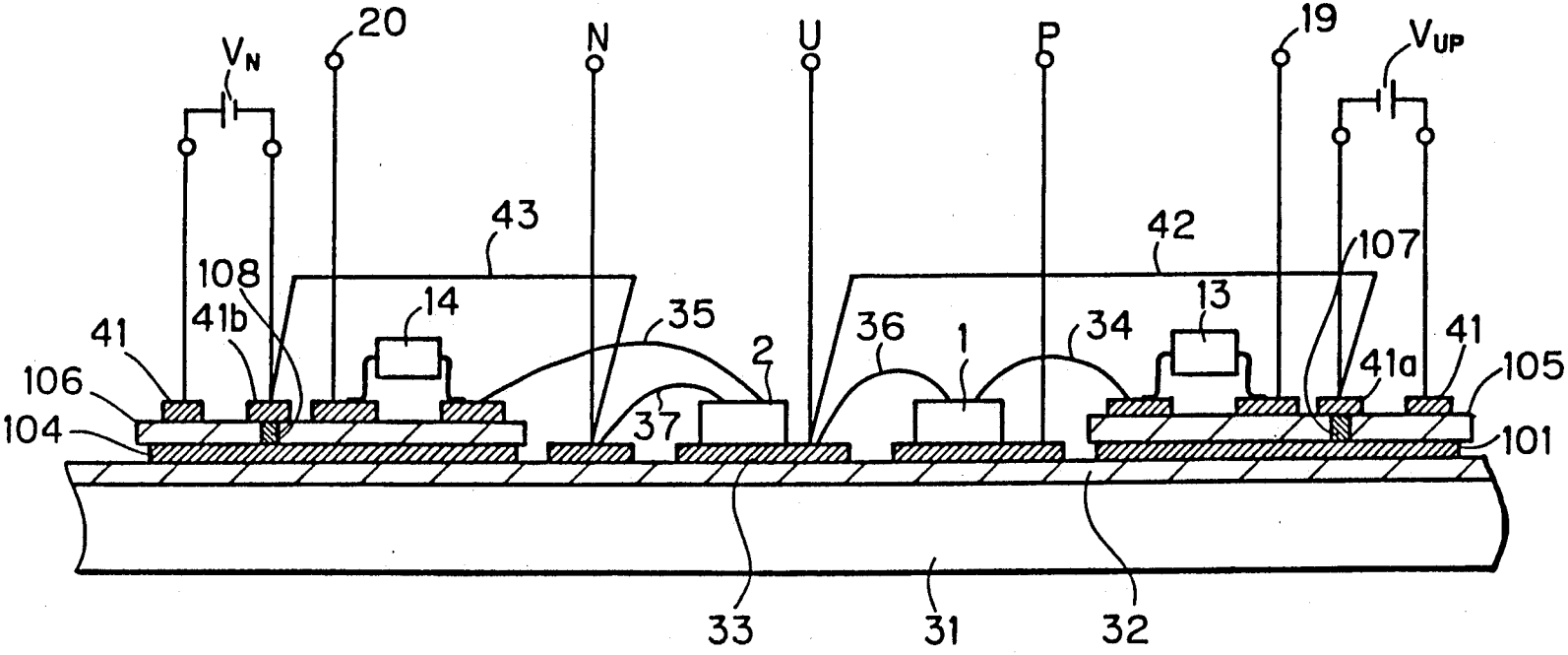
FIG. 6 is a side view of the pusher in a retracted position.
Figure 8:
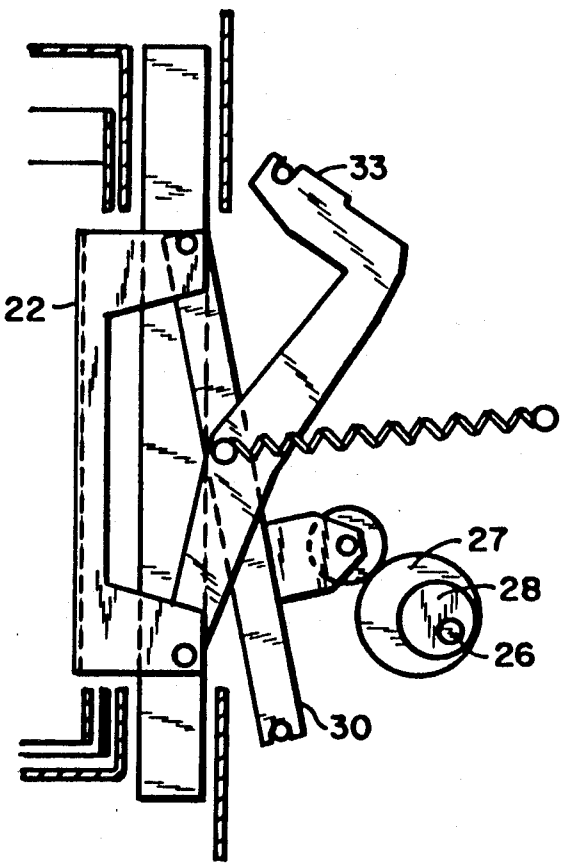
FIG. 8 is a side view of the pusher in a long-stroke cycle.
Figure 7:
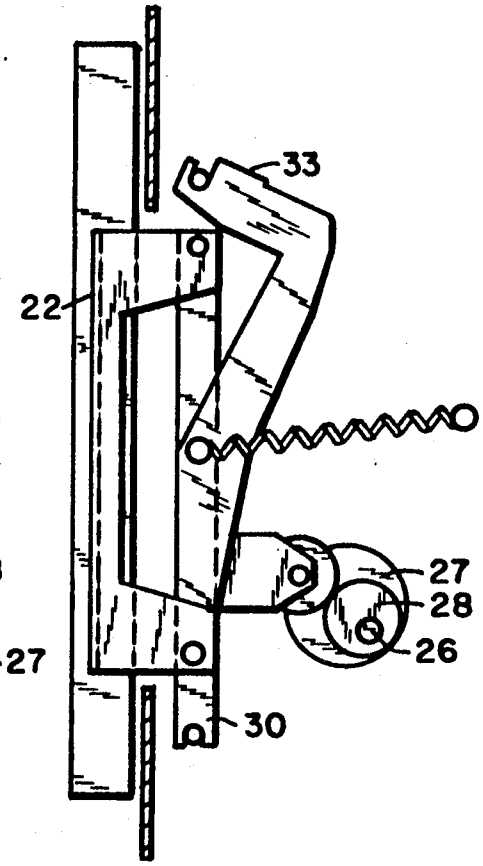
FIG. 7 is a side view of the pusher in a short-stroke cycle.
Figure 6:
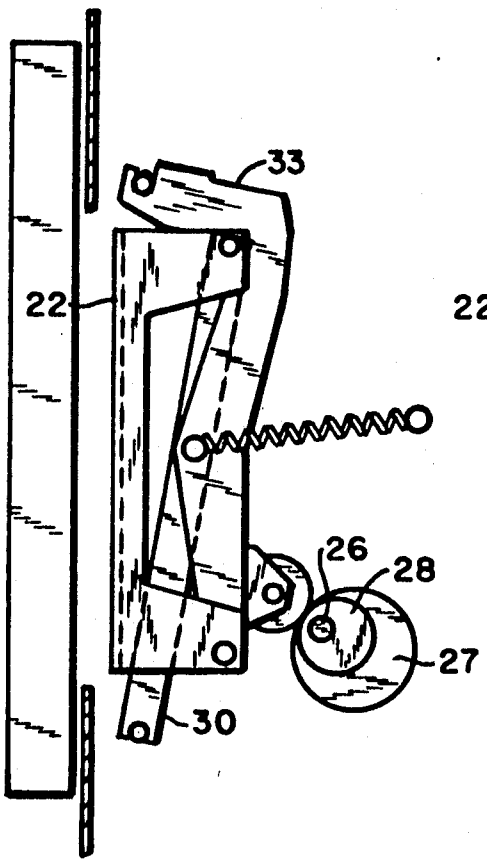

As noted previously, stacker 50 is contained within vault 39 (FIG. 3). The action of a locking mechanism 108 enables moving the gate or door 110 by means of linkage arrangement 111, thereby securing stacker 50 inside vault 39. The action of two separate keys achieves the desired security objective and permits access to stacker 50. To remove vault 39 from the apparatus, gate 110 must be closed, thereby maintaining the security of stacker 50 inside vault 39.

Figure 16:
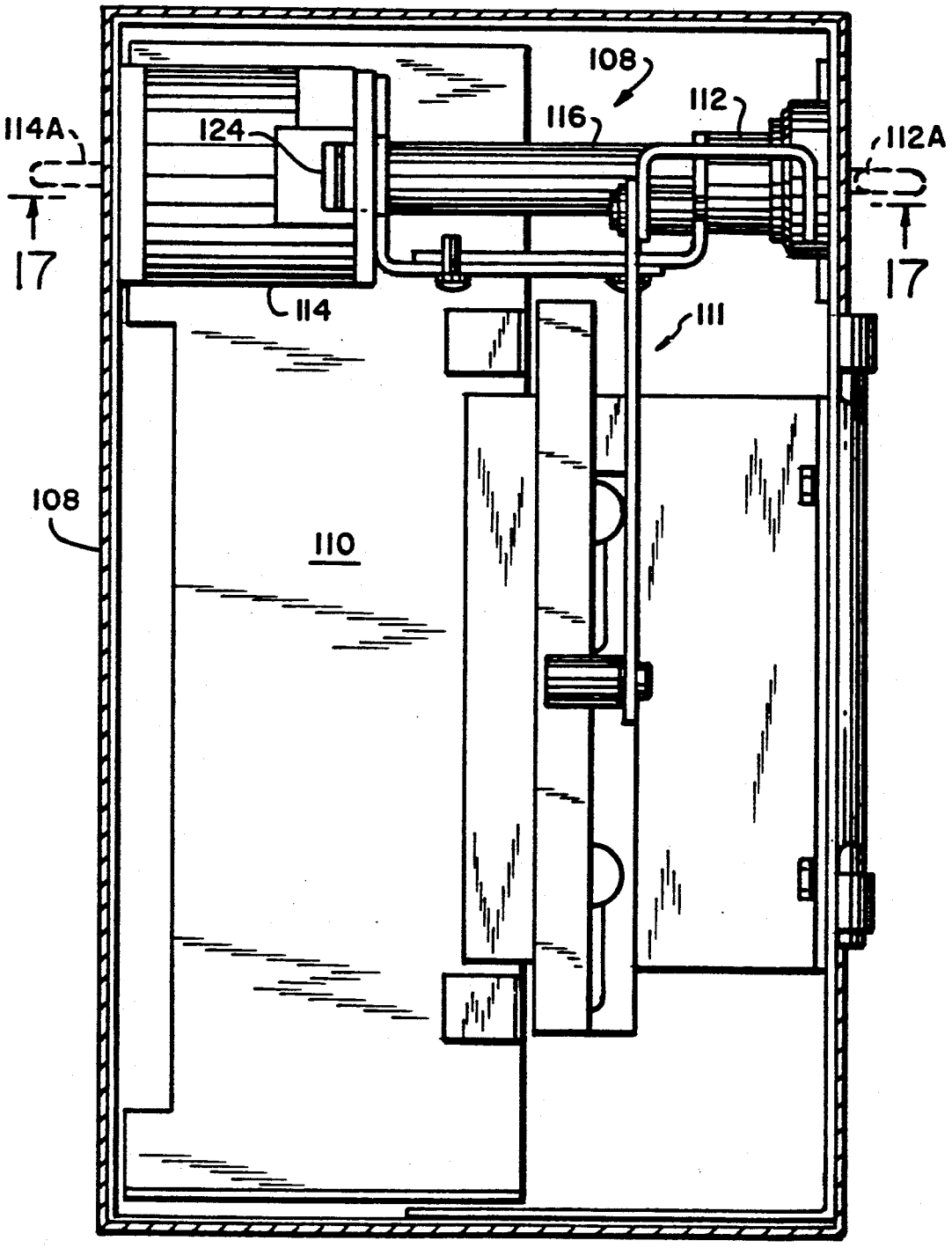
FIG. 16 is another view of the vault, particularly showing the locking mechanism therefor.
Figure 17:
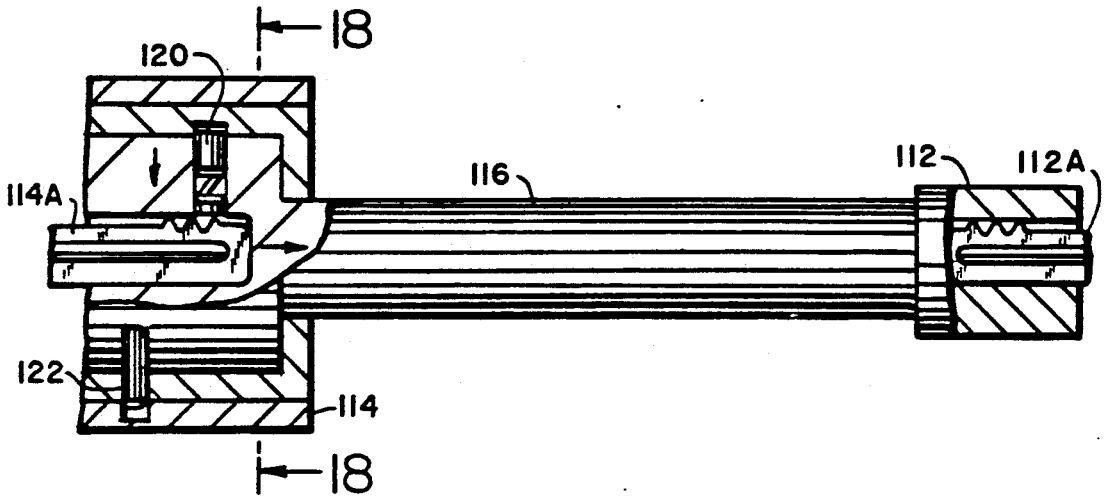
FIG. 17 is a view of the locking mechanism taken on the line 17—17 in FIG. 16.
Figure 18:
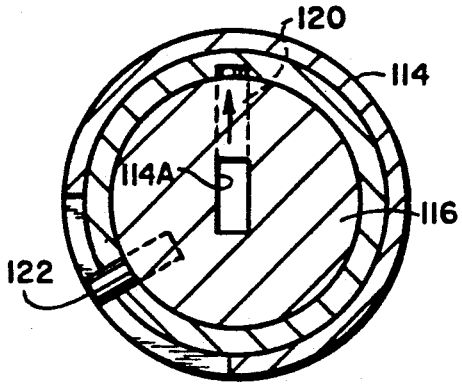
FIG. 18 is a sectional view of the lock 114, taken on the line 18—18 in FIG. 17.

It will be seen from FIG. 16 that the locking mechanism 108 comprises a pair of locks 112 and 114 having a common cylinder 116. One of the locks, i.e. 112, is operable by means of a stationary first key 112A, for aiding in securing vault 39 within the apparatus or system; the other lock being operative, by manipulation of a second key 114A, for opening gate 110 on vault 39 so that the vault can be made ready for receiving bills, but only when the vault has been placed within the apparatus in the proper position for reception by key 112A which is affixed to the frame 118. This reception of key 112A by lock 112 results in releasing cylinder 116 for rotation, by dint of depression of lug 120 which normally prevents such rotation. When cylinder 116 is rotated 45 degrees clockwise by manipulation of key 114A in lock 114, another lug 122 on the cylinder acts to prevent movement of vault 39 with respect to key 112A.

Thus, it will be appreciated that both keys must be in place in their respective locks to produce either the aforesaid opening or closing of gate 110. Likewise, two keys must be used when it is desired to remove the collected bills from vault 39 at the "counting house". Further included within vault 39 is battery operated means 124, responsive to closure of gate 110, for sending a signal by line 61 to the control unit 60 for enabling operation of the entire system for processing the bills.

While I have shown and described several embodiments in accordance with my invention, it is to be clearly understood that the same are susceptible to numerous changes apparent to one skilled in the art. Therefore, I do not wish to be limited to the details shown and described, but intend to cover all changes and modifications which come within the scope of the appended claims.

What is claimed is:

1. Multiple bill escrow and storage apparatus, comprising:

a validator unit for validating paper money bills having an outlet through which each accepted bill is ejected;

a means capable of receiving bills from said validator unit;

a conveyor means disposed near said receiving means, said conveyor means being capable of moving a bill from said validator unit to a handling station;

an escrow box movably disposed adjacent, and to the side of, said handling station, said escrow box having retaining means for holding multiple bills therein;

transfer means mounted at said handling station for transferring a bill from said conveyor means into said escrow box, said transfer means being reciprocally movably mounted adjacent, and to the side of, said escrow box;

a vault mounted adjacent, and to the side of, said escrow box;

actuating means coupled to said transfer means for selectively transferring a bill into said escrow box and from said escrow box into said vault, said actuating means being capable of driving said transfer means through said conveyor means to push a bill or bills from said conveyor means into said escrow box;

means for reciprocally moving said escrow box between said handling station and an ejection station; and an ejection means disposed at said ejection station for ejecting said bill or bills contained in said escrow box such that said ejected bill or bills are ejected in a folded state.

2. The apparatus according to claim 1, wherein said ejection means comprises a return plate reciprocally movably mounted opposite said escrow box when in said ejection station and an actuating means driving said return plate through an opening in said escrow box to push said bills from said escrow box into a return compartment.

3. The apparatus according to claim 2, wherein said ejector station includes pressure means for exerting sufficient pressure on said bill or bills against said return plate wherein said bill or bills are retained on said return plate and released from said escrow box; and means for retaining said bill or bills in a forward position within said return compartment, said retaining means providing the necessary force to keep said bills from sliding back as the return plate is retracted from said return compartment.

4. A multiple bill escrow and storage system, comprising:

a validator unit for validating, for a single transaction to be executed by the system, a plurality of paper money bills of varying denominations, said validator unit having an outlet through which each accepted bill is ejected;

a control unit, coupled to said validator unit, for receiving signals from said validator unit representative of said bills, and for calculating the total value of said bills;

a first sensor means for detecting the bill exiting said validator unit;

a means capable of receiving the bills from said validator unit;

a conveyor means disposed near said receiving means, said conveyor means being capable of moving the bills from said validator unit to a handling station, said conveyor means being controlled via said control unit;

a second sensor means for detecting the position of the bills on said conveyor means;

an escrow box movably disposed adjacent, and to the side of, said handling station, said escrow box having retaining means for holding multiple bills therein;

transfer means mounted at said handling station for transferring the bills from said conveyor means into said escrow box, said transfer means being reciprocally movably mounted adjacent, and to the side of, said escrow box;

a vault mounted adjacent, and to the side of, said escrow box;

actuating means coupled to said transfer means for selectively transferring the bills into said escrow box and from said escrow box into said vault, said actuating means being capable of driving said transfer means through said conveyor means to push the bills from said conveyor means into said escrow box and wherein said actuating means is controlled by said control unit;

means for reciprocally moving said escrow box between said handling station and an ejection station, said means being controlled by said control unit; and an ejection means disposed at said ejection station for ejecting the bills contained in said escrow box such that said ejected bills are ejected in a folded state.

5. The system according to claim 4, in which said ejection means comprises a return plate reciprocally movably mounted opposite said escrow box when in said ejection station, said actuating means driving said return plate through an opening in said escrow box to push said bills from said escrow box into a return compartment, said actuating means being controlled by said control unit.

6. The system according to claim 5, in which said ejector station includes pressure means for exerting sufficient pressure on said bills against said return plate such that said bills are retained on said return plate and released from said escrow box; and means for retaining said bills in a forward position within said return compartment, said retaining means providing the necessary force to keep said bills from sliding back as the return plate is retracted from said return compartment.

7. The system according to claim 4, in which two locks, having a common cylinder, are provided on said vault such that two keys must be inserted in the respective locks to gain access to the bills within said vault.

8. The system according to claim 7, in which the key for the first of said vault locks is affixed to a frame member of the system adjacent to the first vault lock such that said key is received in the first lock when the vault is inserted in the system, whereupon the key for the second lock, when turned, causes rotation of the cylinder and opening of a gate on said vault so that said vault is secured to the frame member of the system and is readied for receiving bills.

9. The system according to claim 8, further including a means for sending a signal to said control unit, responsive to said vault being readied, for enabling operation of the system to process the bills.

* * * * *